US006292954B1

(12) United States Patent
O'Bradaigh et al.

(10) Patent No.: US 6,292,954 B1
(45) Date of Patent: Sep. 25, 2001

(54) PROTECTIVE HEADGEAR

(76) Inventors: Conchur O'Bradaigh, Brockagh, Castlegar; Patrick Feerick, Emeracly, Milltown, both of County Galway (IE)

( * ) Notice: Subject to any disclaimer, the term of this patent is extended or adjusted under 35 U.S.C. 154(b) by 0 days.

(21) Appl. No.: 09/432,072

(22) Filed: Nov. 2, 1999

(30) Foreign Application Priority Data

Nov. 2, 1998 (IE) ..... S98 0904

(51) Int. Cl.[7] ..... A42B 1/08
(52) U.S. Cl. ..... 2/424; 2/9
(58) Field of Search ..... 2/424, 425, 9

(56) References Cited

U.S. PATENT DOCUMENTS

| | | | | |
|---|---|---|---|---|
| 1,016,029 | * | 1/1912 | O'Shea | 2/9 |
| 1,186,442 | * | 6/1916 | Schaefer | 2/9 |
| 1,387,307 | * | 8/1921 | Pohlmann | 2/9 |
| 1,775,009 | * | 9/1930 | Weber | 2/9 |
| 4,021,858 | | 5/1977 | Neeld et al. | 2/9 |
| 4,631,758 | | 12/1986 | Newman et al. | 2/424 |
| 5,184,354 | * | 2/1993 | Alfaro et al. | 2/425 |
| 5,384,914 | * | 1/1995 | Caveness et al. | 2/9 |
| 5,479,658 | | 1/1996 | Harris | 2/9 |
| 5,661,849 | * | 9/1997 | Hicks | 2/9 |
| 5,737,770 | * | 4/1998 | Chen | 2/9 |
| 5,952,078 | * | 9/1999 | Park | 428/105 |
| 5,956,777 | * | 9/1999 | Popovich | 2/424 |

FOREIGN PATENT DOCUMENTS

| | | |
|---|---|---|
| 0156599 | 10/1985 | (EP) . |
| 0466618 | 1/1992 | (EP) . |

* cited by examiner

*Primary Examiner*—Rodney M. Lindsey
(74) *Attorney, Agent, or Firm*—Jacobson Holman, PLLC

(57) ABSTRACT

Protective headgear in the form of a helmet (1) and a face mask (2) of a cage-like construction connected to the helmet (1) by loop straps. The face mask (2) is formed from rigid bars (7,8). The bars (7,8) are of a fiber reinforced polymer composite material co-consolidated at a number of intersections. The fibers forming one bar are physically anchored to the fibers of another bar at the intersection (9) by interleaving, knotting, stitching, stapling, etc. The anchoring of the fibers gives considerable added strength at the intersections (9) as the integrity of the joint is not dependent on the properties of a thermosetting or thermoplastics polymer material. Helmets are made in the same way.

38 Claims, 15 Drawing Sheets

PROTECTIVE HEADGEAR

BACKGROUND OF THE INVENTION

1. Field of the Invention

The present invention relates to protective headgear of the type comprising a covering for portion of a user's head of a substantially cage-like structure comprising rigid bars.

2. Description of the Related Art

Such headgear usually comprises a protective helmet and a face mask attached thereto. Conventionally the protective headgear is more generally of a relatively solid material and the face mask is a grid-type face mask of cage-like structure. The face mask is formed in the shape of a cage by crossing or intersecting bars for encompassing some or all of the wearer's face. It is known to provide a helmet as well which consists of bars with open spaces between the bars to allow the head of the wearer to breathe, a typical example of this is the bicycle helmet. The bars of the face mask have hitherto been of greater rigidity than those of the helmets as the cross-sectional area of the bars for the former is more critical than the latter.

Protective headgear is used extensively in sports to protect a wearer from a ball or other impact such as being struck by another player wielding a playing stick such as a hockey stick, baseball bat or hurley, or simply to protect from damage on contacting a fixture or structure on or adjacent the playing field, or falling onto a hard playing surface. It is now common to use such face masks in almost all sports such as hurling, ice hockey, lacrosse, cricket, baseball, American football and indeed in non-contact sports such as mountaineering, canoeing, kayaking and so on.

The construction of a face mask is always a compromise as there is a basic contradiction between providing maximum protection and maximum visibility. Thus, the bars making up such a face mask must be as thin as possible while at the same time being sufficiently strong. Heretofore, these face masks were generally manufactured from steel. The problem is that steel of its nature is relatively heavy and thus such face masks are often quite heavy, in some cases exceeding even 300 g. In many instances, this provides considerable discomfort for the user. Further complex and intricate shapes and designs are difficult to provide when steel is the chosen material.

Typical examples of such face masks are, for example, a hockey face mask such as described in U.S. Pat. No. 4,021,858 (Neeld et al), U.S. Pat. No. 4,631,758 (Newman et al) and U.S. Pat. No. 5,479,658 (Harris). In an attempt to overcome the problems inherent in the manufacture of such face masks and protective headgear generally from steel it is known to provide for example a face mask of a plastics material, however, such face masks have not been particularly successful heretofore. U.S. Pat. No. 4,631,758 referred to above also suggests that a face mask could be manufactured from a suitable fibre reinforced composite material and European Patent Specification No. 0 466 618 (Schappe) describes the manufacture of such a composite material comprising reinforcing fibres, for example, of carbon, aramid or glass which are generally in the form of multi-filaments woven with multi-filaments of thermoplastic matrix fibres. Another example of a composite carbon fibre and thermoplastics fibre blend is described in European Patent Specification No. 0 156 599 (Celanese Corporation).

Heretofore very little attention has been paid to the manufacture of helmets forming part of a protective headgear from such materials. While it has been suggested that headgear in the form of a face mask can be manufactured from such polymer composite materials co-consolidated together, they have not as of yet been particularly successful. The problem appears to have been that while the fibre reinforced polymer composite material which is co-consolidated together at a number of intersections to form a grid has provided what is apparently a light-weight and strong face mask this has not been the situation in practice. On impact the face mask has tended to disintegrate in the sense that the bars forming the grid or cage-like construction tend to come apart laterally i.e. in the direction of the impact at the intersections and thus are not sufficiently rigid to provide adequate protection. A similar problem would arise with a cage-like helmet manufactured in this way. Indeed the inventors are not aware of such a construction of helmet having been produced except in steel.

The present invention is directed towards providing protective headgear of substantially cage-like construction comprising rigid bars of a suitable fibre reinforced composite material which will be considerably lighter than those heretofore provided and which at the same time will be sufficiently structurally strong as to protect a users head and face.

SUMMARY OF THE INVENTION

According to the invention there is provided protective headgear of the type comprising a covering for portion of a user's head of substantially cage-like construction comprising rigid bars wherein the rigid bars are formed of a fibre reinforced polymer composite material co-consolidated together at a number of intersections, and in that at least some of the fibres of one bar are physically anchored to the fibres of another bar at each intersection. Once the fibres of one bar are physically anchored to the fibres of another bar, then if an impact occurs the strength of the fibres is retained and the one bar will not separate from the other.

Ideally, each bar comprises a bundle of yarns, each yarn being formed of aligned reinforcing fibres embedded in a polymer matrix material and in which at least some of the yarns of a bundle forming a bar are anchored to some of the yarns of another bundle forming another bar by interleaving the yarns at the intersection. The interleaving of the bars is a particularly easy way of anchoring one bar to another because by interleaving the bars you have of necessity reinforcing fibres of one bar above and below the reinforcing fibres of the other bar.

The yarns can be manufactured as a bundle in many ways, for example, the bundle may comprise a plurality of lengths of yarn twisted together to form a coherent bundle. This is a well known way of providing what is effectively a rope of reinforcing fibres and polymer filaments which can then be used in a mould.

Alternatively, the yarns forming each bundle are longitudinally arranged in collimated configuration.

In the latter case, ideally additional yarns are double-helically wrapped or braided around the longitudinally arranged yarns to form an outside retention covering over a core of the longitudinally arranged collimated yarns. These are particularly suitable and well known ways of making a bundle of such yarns.

Alternatively, the yarns of a bundle may be physically connected to the yarns of another bundle by for example, the yarns of a bundle projecting through the bundle forming another bar at the intersection.

Alternatively the bundle forming one bar is wrapped around another bar at the intersection and indeed in the latter case when there is a T shaped connection the bundle is wrapped around the bar and back on itself.

In a further embodiment the bundle is knotted to another bundle at the intersection. All of these are relatively simple ways of mechanically anchoring of one bar to another and will achieve the object of the present invention.

In one embodiment of the invention some of the yarns forming a bar are turned at the intersection away from the other yarns, such that the yarns form at least part of two other bars projecting away from the intersection. This is a particularly effective way of ensuring that there is adequate anchoring between the fibres.

In another embodiment of the invention there are at least three bars forming an intersection with a hole therebetween, each bar being interleaved with two adjacent bars lying above one and below the other and indeed in many instances four bars forming a substantial rectangular hole therebetween will be used. These just happen to be very neat and efficient ways of anchoring the bars together.

Alternatively a more direct physical anchoring may be achieved in which case the bars are tied together at each intersection. Similarly the bars may be stitched, stapled or pinned together at each intersection. Again these are relative simple and easy ways of attaching the bars together which will allow a flexible preform to be provided which can be placed easily in a mould.

Ideally, the bars are interconnected by infill panels formed of a fibre reinforced polymer composite material co-consolidated with the bars. This will allow, for example, a user's face to be protected in particularly sensitive areas, which can be of considerable advantage and because the infill panels are formed of the same material as the bars, there will be a natural and easy co-consolidation between them.

The protective headgear may be a face mask, it may be a helmet, or indeed it may be a face mask and a helmet as the one protective headgear.

Further the invention provides a process for moulding protective headgear of this type comprising the initial steps of:

taking a yarn of a fibre reinforced polymer composite material;

forming a flexible bar from one or more yarns;

forming from the flexible bars a cage-like structure having bars meeting at intersections;

connecting the flexible bars at each intersection such that some of the fibres of one flexible bar are physically anchored to the fibres of another flexible bar with some of the fibres of each flexible bar are above and below the fibres of the other flexible bar; and then subsequently forming the preformed flexible cage-like structure in a mould to produce a rigid structure.

By making the preform, as it were, prior to any moulding, it is possible to provide suitable sizes of preform which can then be placed in a mould.

The invention further provides a process for moulding protective headgear having the desired cage-like structure for bars meeting at intersections comprising:

forming reinforcing fibres into a fibres only yarn;

laying the fibres only yarn in a mould;

connecting the reinforcing fibres together at each intersection so that at least some of the fibres of the fibres only yarn are physically anchored by the fibres of another fibres only yarn such that some of the fibres of each fibres only yarn are above and below the fibres of the other fibres only yarn; and subsequently introducing polymer material into the mould and processing the polymer material to form rigid bars of fibre reinforced composite material co-consolidated together at the intersections.

This is another very useful way of manufacturing headgear according to the invention.

BRIEF DESCRIPTION OF THE DRAWINGS

The invention will be more clearly understood from the following description of some embodiments thereof, given by way of example only described with reference to the accompanying drawings in which.

DETAILED DESCRIPTION OF THE INVENTION

Figure 2:
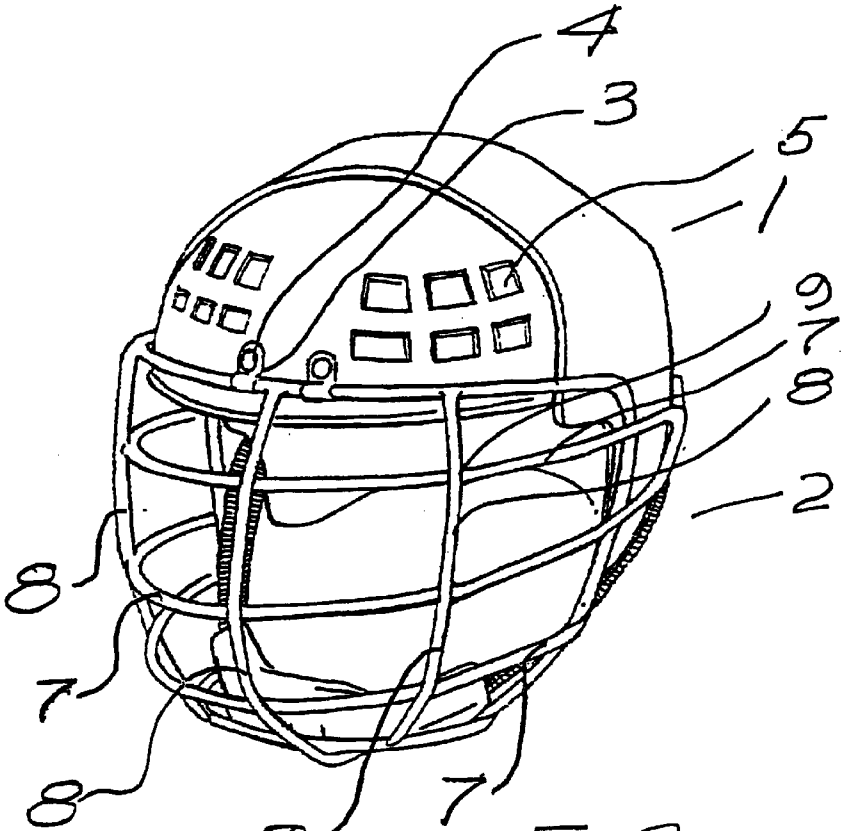
FIG. 2 is a further perspective view from a slightly different angle of the protective headgear of FIG. 1.

Before describing the invention in detail, it is important to discuss briefly the materials used in accordance with this invention. Many fibre reinforced polymer composite materials may be used which can be co-consolidated together both in their formation and, as will be described below, at a number of intersections in the manufacture of cage-like structures which form part of the protective headgear in accordance with the invention, whether they be a helmet, a face mask or a combined helmet and face mask.

The preferred composite materials concerned in this invention are those where reinforcing fibres are aligned in a continuous or semi-continuous manner such as described in European Patent Specification No. 0 466 618. The reinforcing fibres provide the stiffness and strength of the material, whereas the polymer matrix provides the toughness and protects the often brittle fibres. With unidirectional reinforcement, the high stiffness and strength provided by the fibres are only in the fibre direction and not in the direction transverse to the fibres, or at joints which may be made between yarns or sheets of fibre reinforced polymer composite materials when they are co-consolidated together. Thus if two bars made of these materials intersect or cross there is no inherent strength at the intersection if they are simply co-consolidated at the intersection in accordance with normal practice. Because of the particular application of the fibre reinforced composite material, aligned rather than randomly arranged fibres are to be preferred, but are not strictly speaking essential.

The polymer matrix may be thermosetting, or thermoplastic. In the case of thermosetting polymers, the material is processed by the application of heat and pressure. The heat and pressure act to make the polymer less viscous and to make it easier for any air pockets or voids to migrate to the surface. Once the voids have been removed the material is deemed to have been consolidated. A chemical reaction then occurs in the polymer, resulting in a rigid composite material, with low void content.

In the case of a thermoplastics matrix, the material is also processed by application of heat and pressure. The heat serves to melt the thermoplastic polymer, and the pressure to consolidate the material and remove voids. There is no chemical reaction in this case, however, and cooling is sufficient to result in a rigid composite material. Again all of this is well known.

A particularly useful form of material is a commingled or co-blended thermoplastics composite yarn such as discussed in some of the referenced patent specifications. In this material, both the reinforcing fibres e.g. carbon, glass or aramid and the polymer matrix are in the form of fibres, which can be manipulated using standard textile techniques. The resulting preform has the consistency, or feel, of a rope, which can easily conform to curved and complex mould contours. Upon application of heat and pressure, the polymer fibres melt and flow between the reinforcing fibres, thus expelling the air from the preform.

A critical issue in the quality of the final consolidated material achieved is the distribution of the polymer fibres among the reinforcing fibres. A well dispersed blend of both types of fibres will mean that the flow paths for the melted polymer are much shorter than for a poorly dispersed blend, where for example, there might be many reinforcing fibres for each polymer fibre, and thus longer flow paths for the melted polymer, necessitating higher pressures and longer processing times.

Reinforcing fibres provide the strength and stiffness for composite materials and it is desirable to have the fibres aligned in the direction of the bar, as much as possible, in order to provide for a stiff and strong bar.

However, it must be appreciated that these materials, as described above, are only some of the materials that could be used and, for example, pre-impregnated thermoplastic composite materials might be used rather than simply a yarn of commingled fibres. While mainly the application of pressure and heat is considered any other chemical curing could also be considered. Indeed it is envisaged that the injection of uncured thermosetting material or, of an un-polymerised thermoplastics material into a dry fibre preform laid in a mould followed by the subsequent chemical curing of the thermosetting matrix or the polymerisation of the thermoplastic matrix by the application of pressure and heat may be used. Essentially all that is required is that there be a fibre reinforced polymer composite material which can be in some way co-consolidated together at a number of intersections. Thus, all the materials described in the prior art that are suitable for such a process may be used and they are thus not described or listed in detail.

Figure 1:
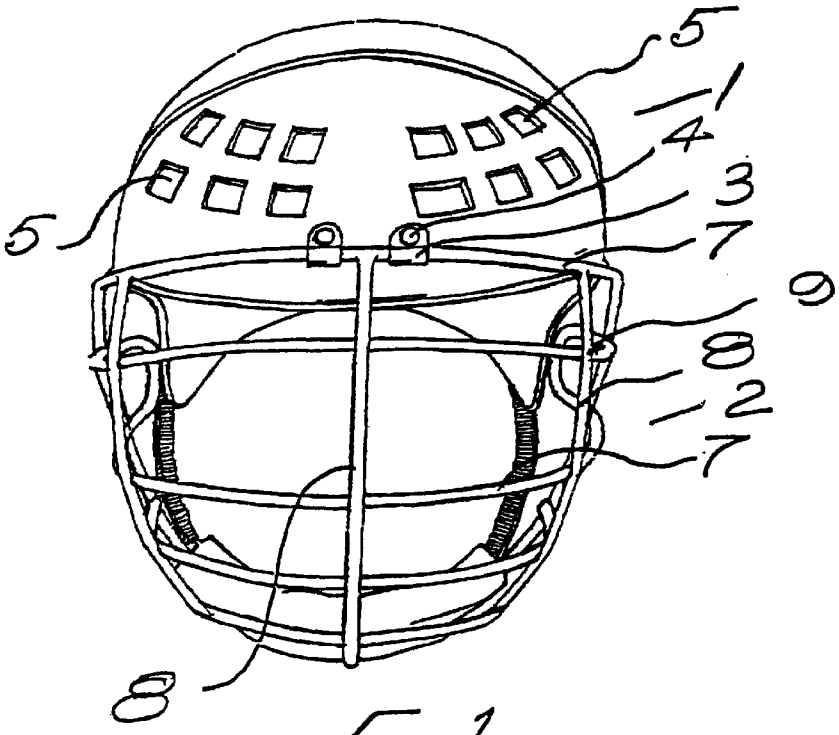
FIG. 1 is a front view of protective headgear in this embodiment a helmet and mask for the playing of hurling.

Referring to the drawings and initially to FIGS. 1 and 2 thereof, there is provided protective headgear in this case a hurling helmet and face mask indicated generally by the reference numerals 1 and 2 respectively. The face mask 2 is connected to the hurling helmet 1 by loop straps 3 secured to the hurling helmet 1 by rivets 4. The hurling helmet 1 is manufactured from a polymer composite material and includes apertures 5 and is of substantially conventional construction and is not described in any more detail. The face mask 2 is of substantially cage-like construction comprising a number of crossing or intersecting bars which can be generally described as horizontal bars 7 and vertical bars 8 all meeting at intersections 9.

In this specification when, for example, two bars namely vertical bars 7 and horizontal bars 8 meet, they are identified in the drawings, on each side of the intersection by different subscript letters where necessary such as 7*a*, 7*b*, 7*c*, etc. or 8*a*, 8*b* and so on. Similarly, different intersections 9 will be distinguished where necessary by subscript letters a, b, c, etc. While more properly one would consider that these bars are continuous, it is advantageous for this specification in many instances to describe and identify a bar as being two separate bars divided by the intersection, even though it is in practice and indeed it appears to be a continuous vertical or horizontal bar running across a helmet or face mask manufactured in accordance with the invention.

Figure 4:
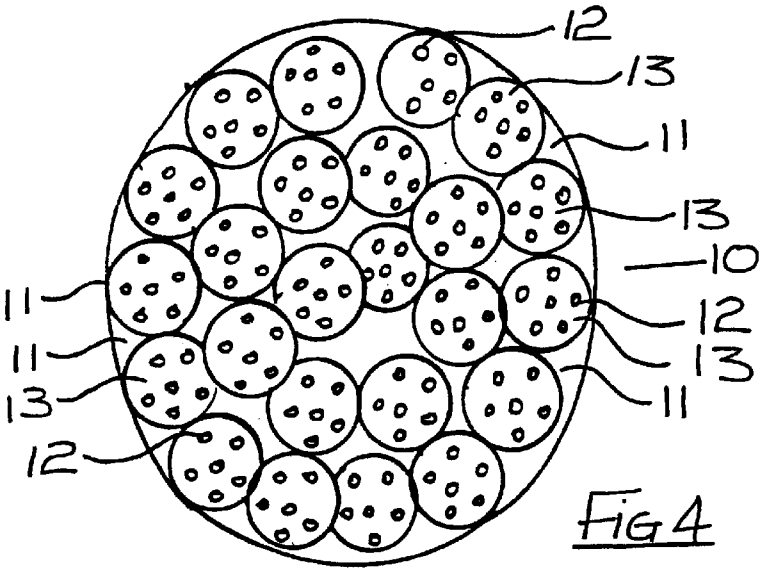
FIG. 4 is an end view of the bundle of yarns of FIG. 3.
Figure 3:
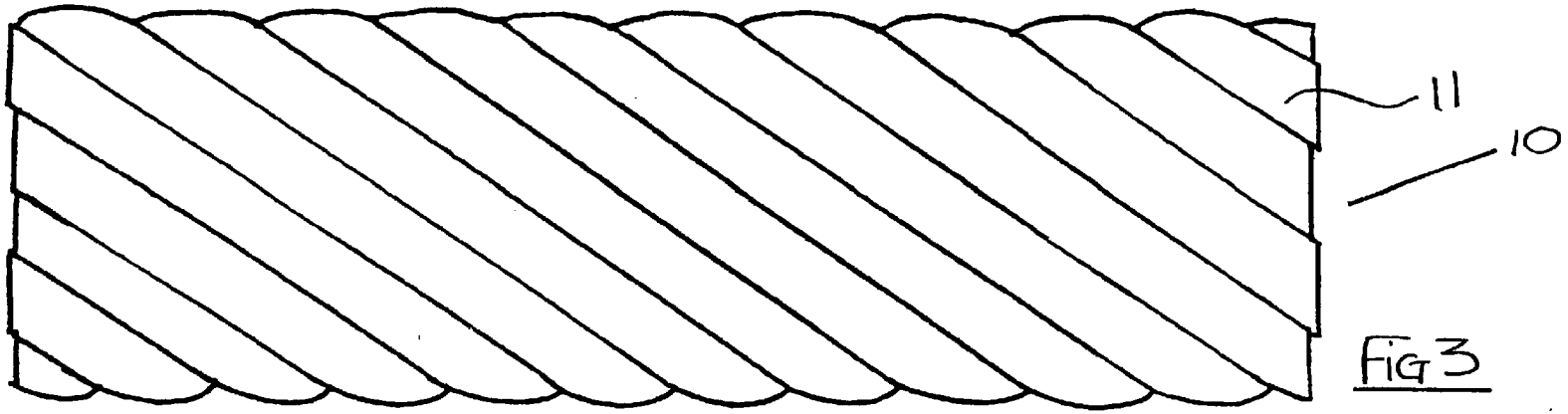
FIG. 3 is a side view of a bundle of yarns used in accordance with the invention.

Referring to FIGS. 3 and 4 there is illustrated a bundle indicated generally by the reference numeral 10 of yarns 11 twisted together to form a coherent bundle 10. Each yarn 11 comprises aligned reinforcing fibres 12 in a polymer matrix material 13. This illustrates the bundle 10 before any consolidation of the reinforcing fibres 12 and the matrix material 13.

Figure 5:
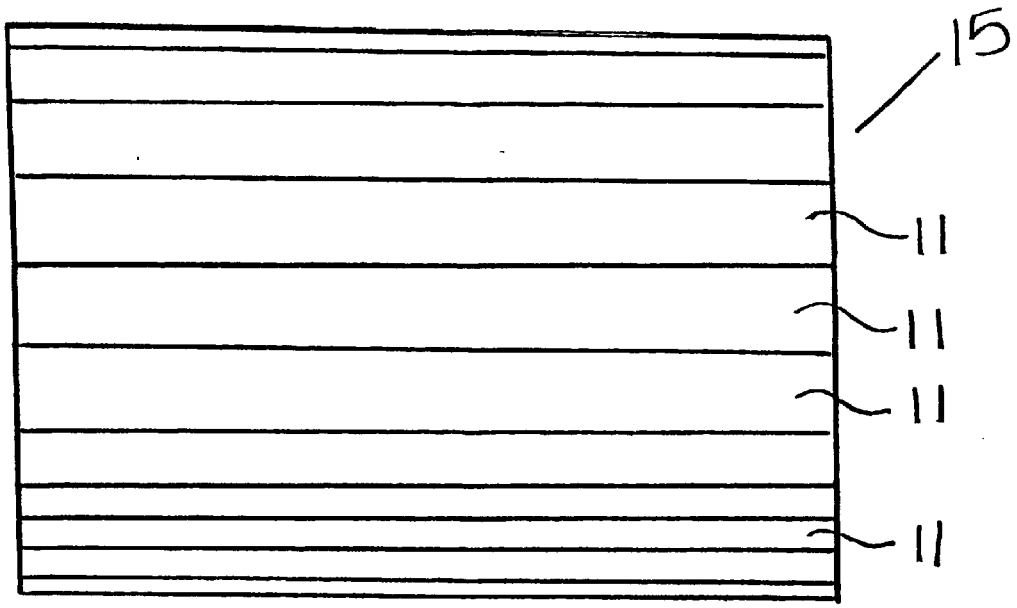
FIG. 5 is a side view of an alternative construction of a bundle of yarns according to the invention.
Figure 6:
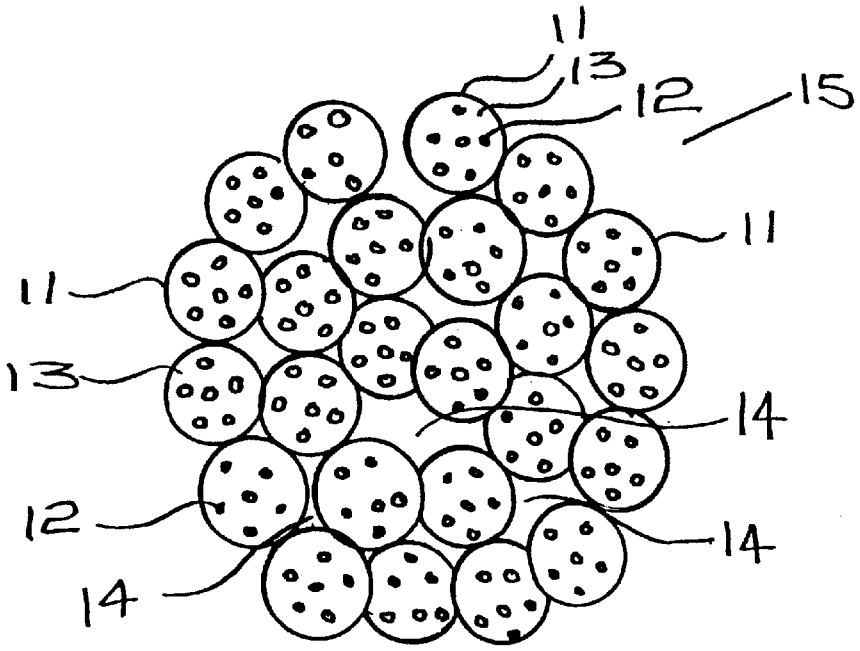
FIG. 6 is an end view of the bundle of yarns illustrated in FIG. 5.

Referring now to FIGS. 5 and 6 there is shown an alternative construction of bundle, indicated generally by the reference numeral 15, again comprising yarns 11 of aligned unidirectional reinforcing fibres 12 in a polymer matrix material 13. In this embodiment the yarns 11 forming each bundle 15 are longitudinally arranged in side-by-side or more correctly collimated configuration. It will thus be noted that there are voids 14 between the yarns 11.

Figure 7:
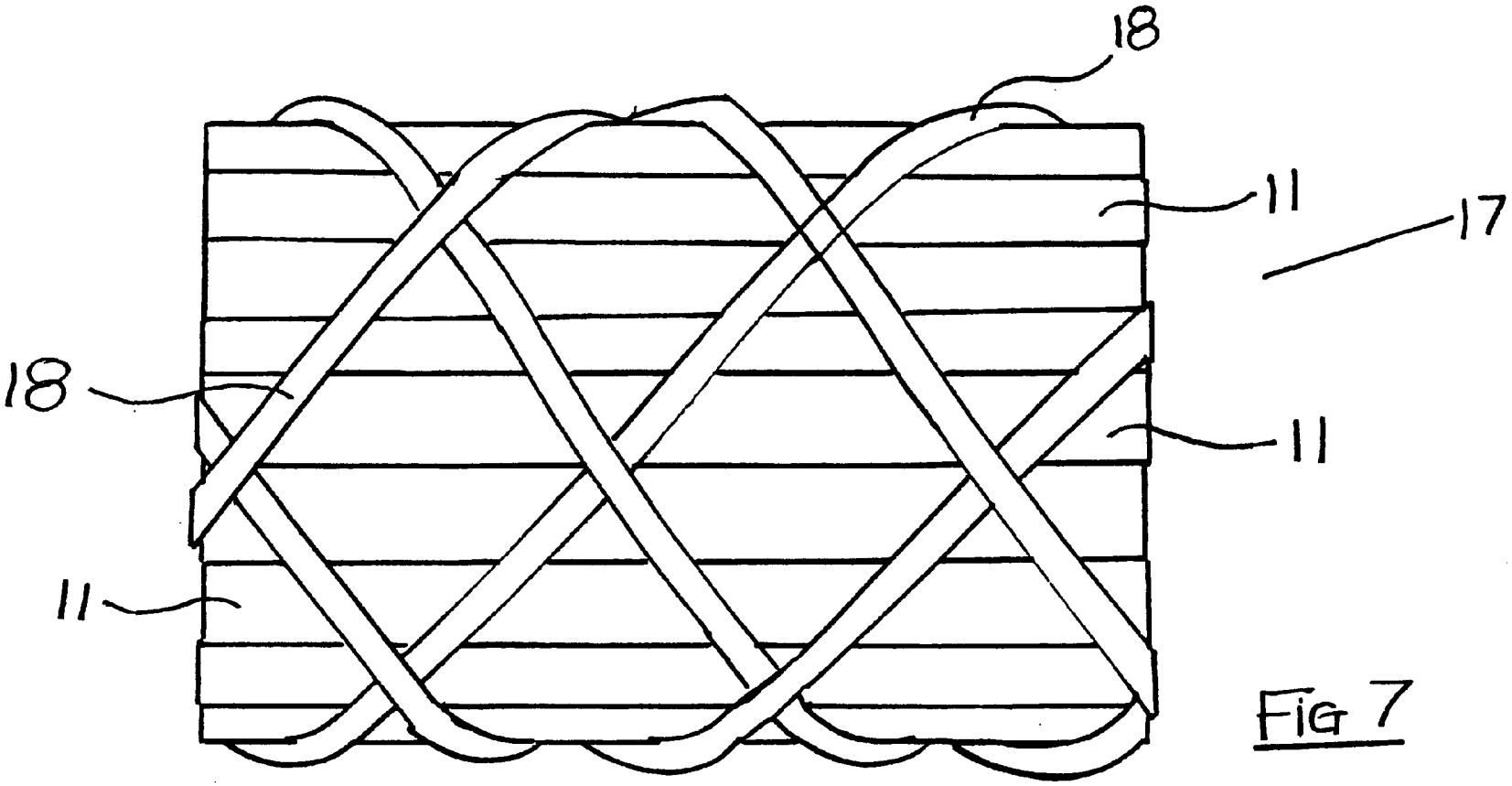
FIG. 7 is a side view of another bundle of yarns according to the invention.
Figure 8:
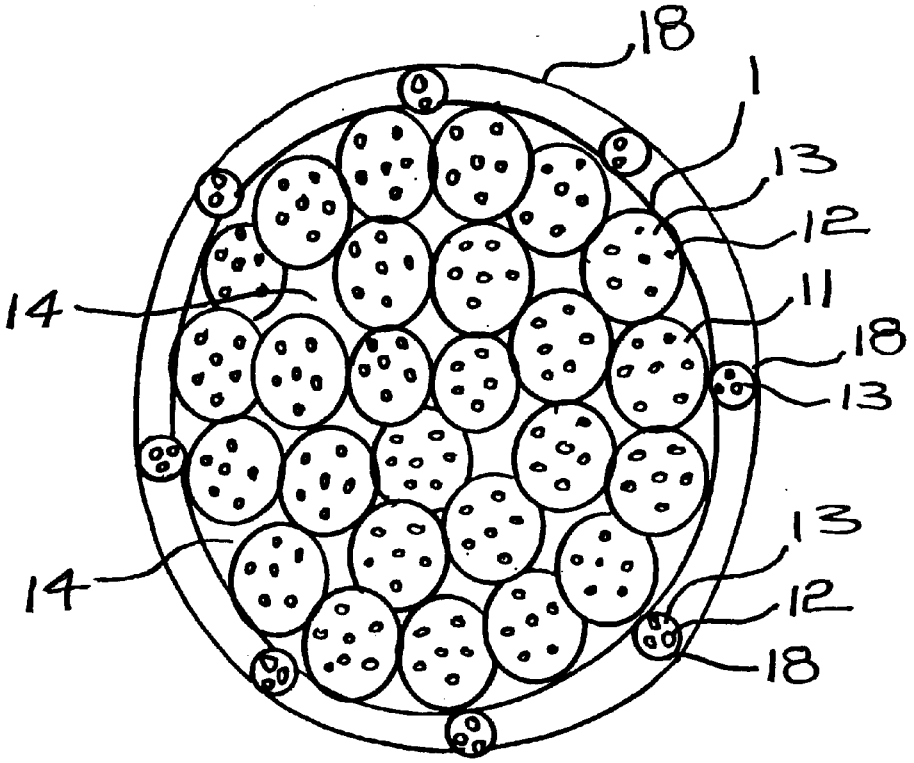
FIG. 8 is an end view of the bundle yarns of FIG. 7.

FIGS. 7 and 8 show a still further construction of bundle indicated generally by the reference numeral 17 in this embodiment comprising an inner core of yarns 11, again of aligned unidirectional reinforcing fibres 12 in a matrix material 13 which are longitudinally arranged in exactly the same way as the yarns 11 in FIGS. 5 and 6 and thus similar parts and features are identified by the same reference numerals. However, there is provided additional yarns 18 again of aligned reinforcing fibres 12 and polymer matrix material 13 which are double helically wrapped or overbraided around the longitudinally arranged yarns 11 to form an outside retention covering over a core of the longitudinally arranged yarns 11. It should be noted that the additional yarns 18 can be of any construction such as a polymer material without reinforcing fibres as their only essential function is to retain the yarns 11 of the core together until the protective headgear is formed. Further the yarns 18 can be closed together or further apart.

Figure 9:
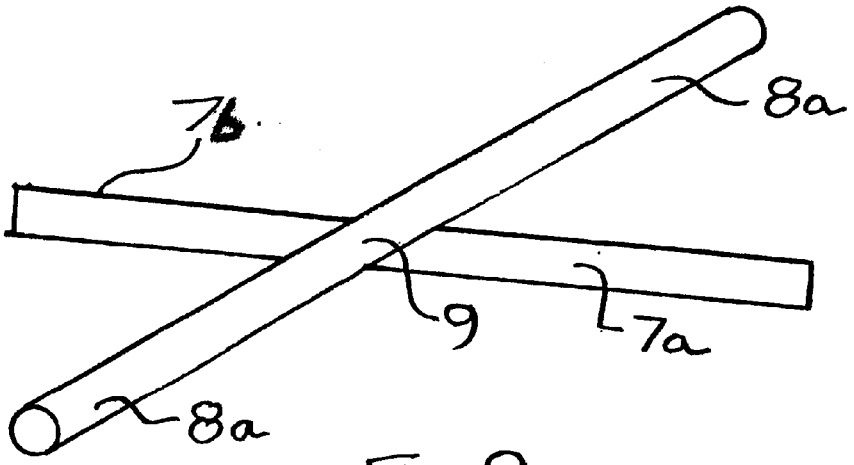
FIG. 9 shows the intersection of bars in accordance with the prior art.

Referring now to FIG. 9 there is illustrated how, in the prior art, the bundles 10, 15 and 17 forming the horizontal bars 7 and the vertical bars 8 would be arranged at an intersection 9. It will be appreciated that the horizontal bars as shown in FIG. 9 and identified by the reference numerals 7*a* and 7*b* simply are overlain by the vertical bars 8*a* and 8*b* at the intersection 9 and if fused by heat or otherwise co-consolidated together will only be secured together by the properties of the unreinforced polymer matrix material as this material will in formation migrate to perform a joint at the intersection between the horizontal bars 7*a* and 7*b* and the vertical bars 8*a* and 8*b* during co-consolidation of the structure. It will be appreciated therefore that this intersection will not provide a sufficiently strong bond between what is effectively the continuous horizontal bar 7 formed by the bars 7*a* and 7*b* and the continuous vertical bar 8 formed by the bars 8*a* and 8*b* at the intersection 8.

Figure 10:
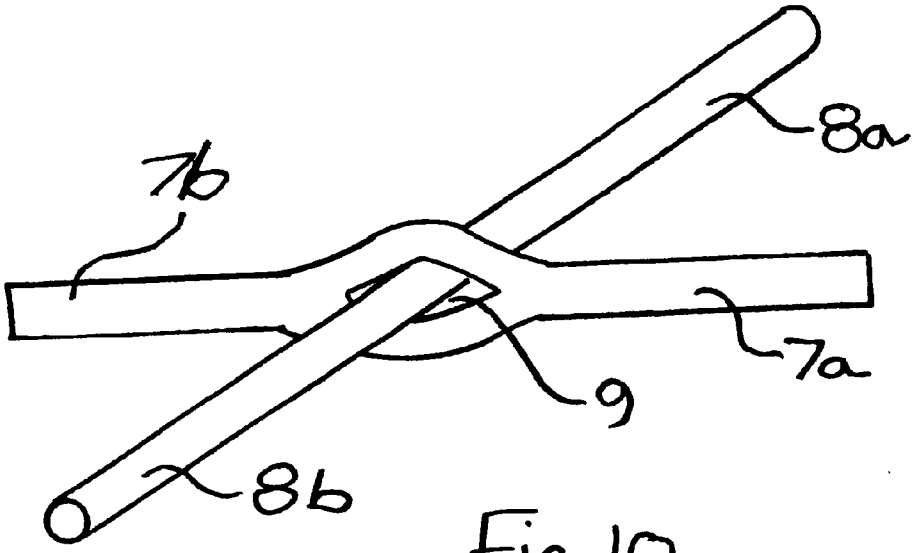
FIGS. 10 to 14 inclusive show various ways of how bars used in accordance with the invention may be anchored.

FIG. 10 refers now to one way in which the bars 7 and 8 are physically anchored in the bundles 10, 15 or 17. There is illustrated vertical bars 8*a* and 8*b* forming one vertical bar 8 projecting through the bundle forming the horizontal bar 7 which again is illustrated by the reference numerals 7*a* and 7*b*.

Figure 11:
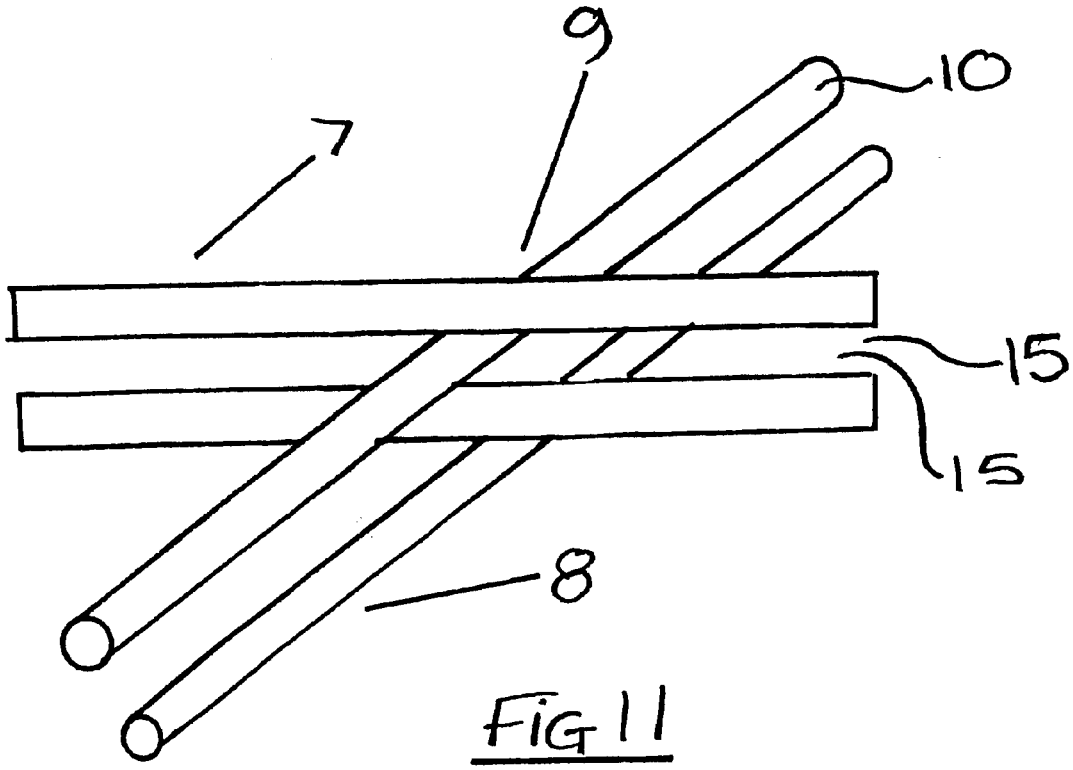

FIG. 11 shows the intersection of horizontal and vertical bars formed from the bundles 15 intersecting. In this embodiment the vertical bars are indicated generally by the reference numeral 8 and the horizontal bars by the reference numeral 7.

Figure 12:
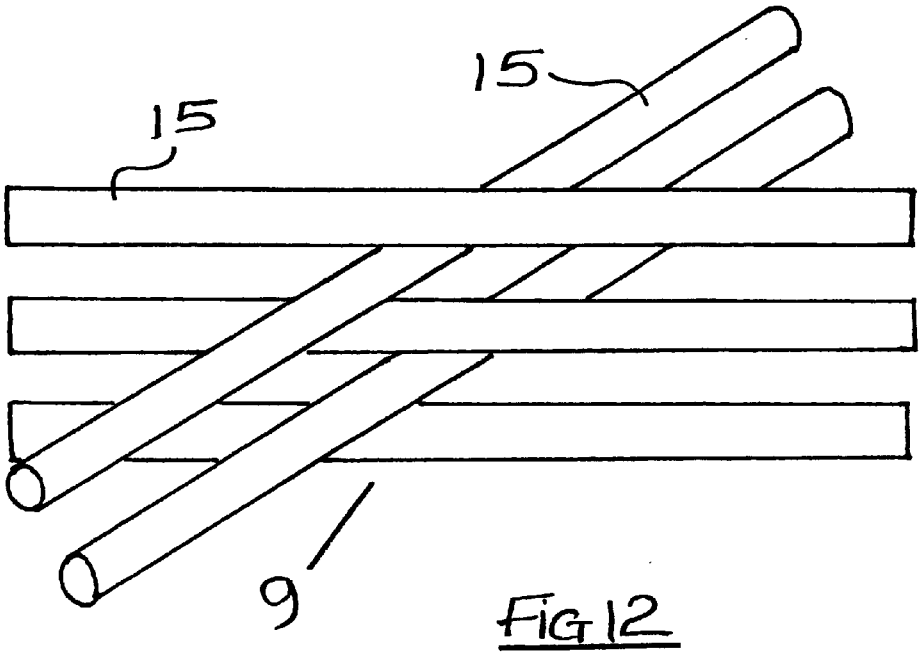

Similarly FIG. 12 shows a further way in which the bundles 15 can intersect. It will be appreciated that this intersection forms a physical anchorage between the horizontal bars 7 and the vertical bars 8. It will be appreciated however that while these have been identified as individual yarns forming bundles 10,15 and 17 that also bundles themselves could be used in the same way and intersected in the same way as the yarns have been shown intersecting in the above embodiments.

Figure 13:
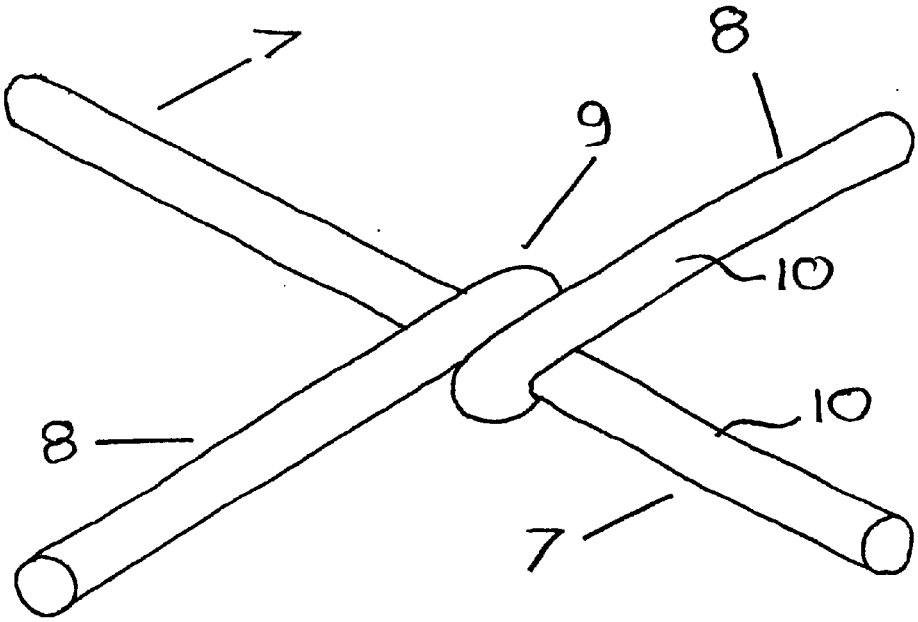

Referring now to FIG. 13 there is illustrated an alternative physical anchoring of the fibres of one bar to the fibres of another bar at an intersection again identified by the reference numeral 9 and again the horizontal bars are identified generally by the reference numeral 7 and the vertical bars by the reference numeral 8. In this embodiment the bundles 10, 15 or 17 forming the vertical bars 8 are wrapped around the bundles 10, 15 or 17 forming the horizontal bars 7. For a Tee style intersection the bar would be wrapped around the other bar and back on itself.

Figure 14:
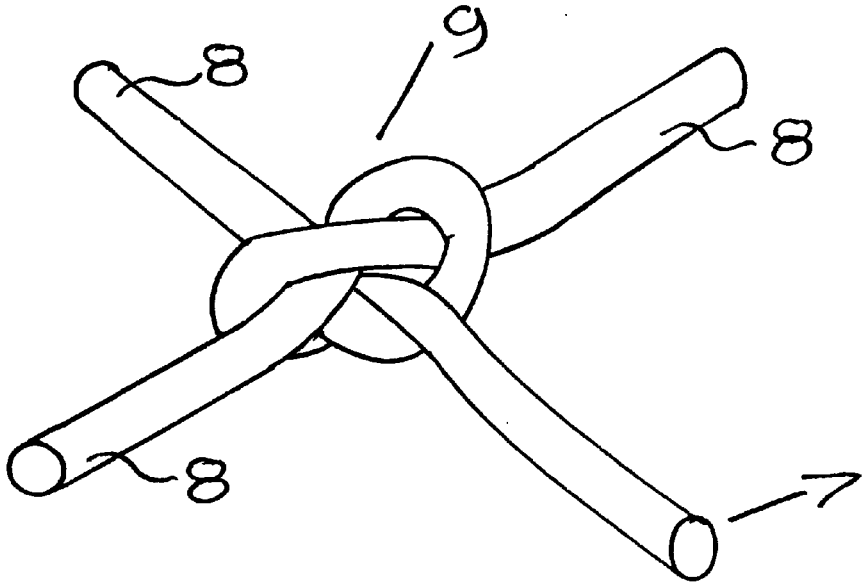

FIG. 14 illustrates, again using the same reference numerals, the bars 7 and 8 knotted together to form the intersection 9.

Figure 15:
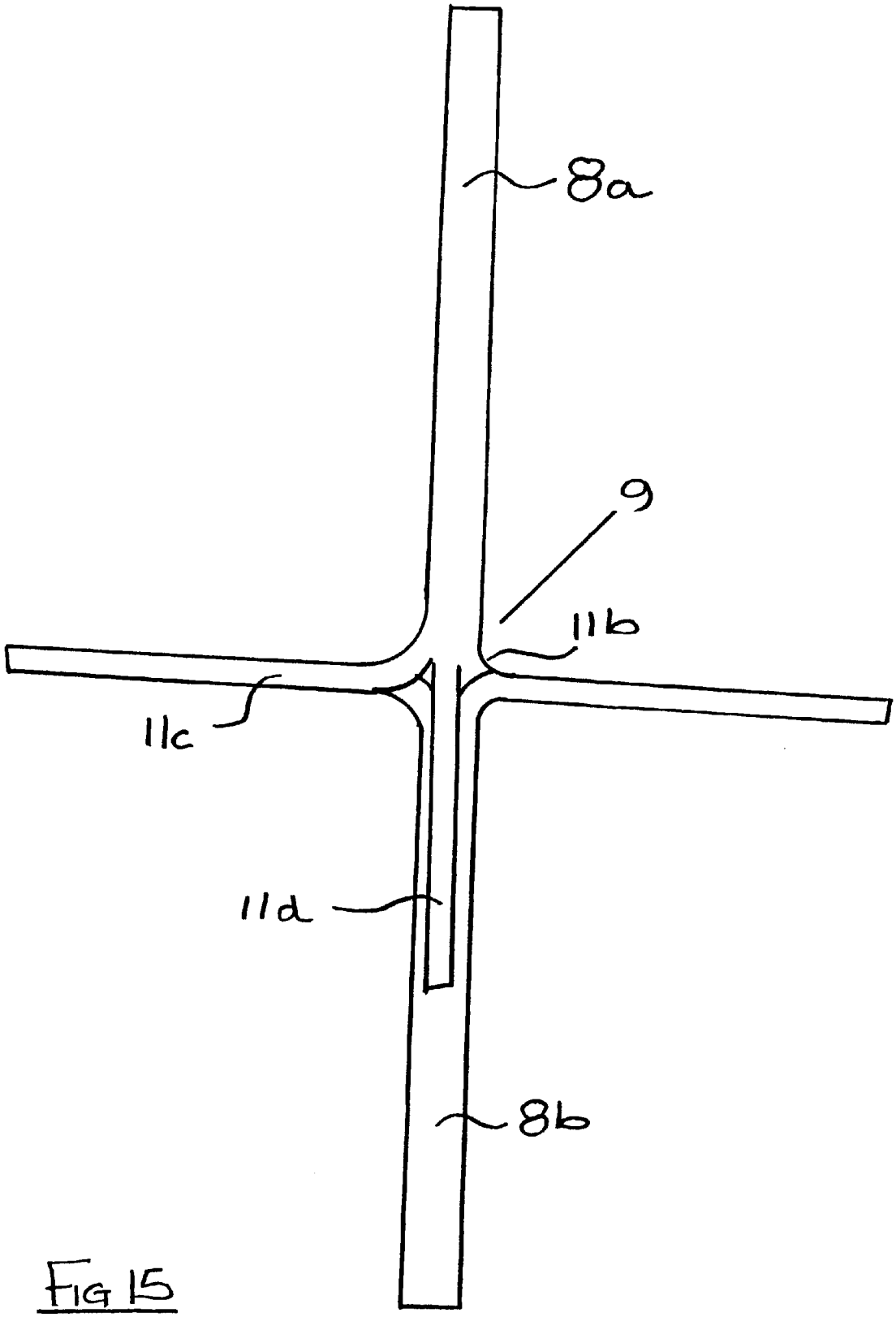
FIG. 15 shows another construction of bars according to the invention.

Referring now to FIG. 15 there is illustrated an intersection of two vertical bars 8*a* and 8*b* in which some of the yarns forming each bar are turned at the intersection 9 away from the other yarns so that the yarns form part of the other bars. Not all of the horizontal bars are shown as this would confuse the drawing. However, referring then to the drawing there is illustrated yarns 11 of a bundle in turn forming part of the vertical bar 8*a* projecting downwards across the intersection 9 to form part of the bar 8*b*. Similarly yarn 11*b*, only a portion of which can be seen, and a yarn 11*c* project laterally on both sides of the bar 8*a* to form eventually part of the horizontal bars that will meet at the intersection 9. The yarns 11*b*, 11*c* and 11*d* form in effect small bundles and there are a large number of bundles used to form each bar. In this way there is a solid physical anchoring of the fibres in each bundle. The bar 8*b* is similarly constructed as can be seen from FIG. 15, but this is not referenced by numerals to avoid confusion. All of the above anchorage methods can be used and involve in some way at least some of the yarns of a bundle forming a bar being anchored to some of the yarns of another bundle forming another bar by interleaving the yarns at the intersection. It is however also envisaged that a more positive physical connection may be used.

Figure 16:
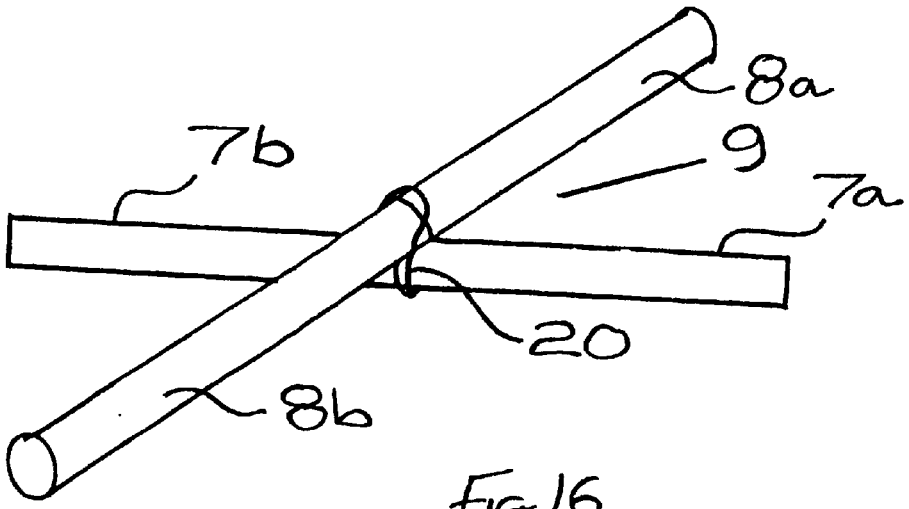
FIGS. 16 to 19 inclusive shows various other ways of anchoring bars together at the intersection of the bars.

Thus referring now to FIG. 16 there is illustrated the tying together by fibres 20 of two vertical bars 8*a* and 8*b* formed as the one continuous bar and horizontal bars 7*a* and 7*b* again forming a continuous bar.

Figure 17:
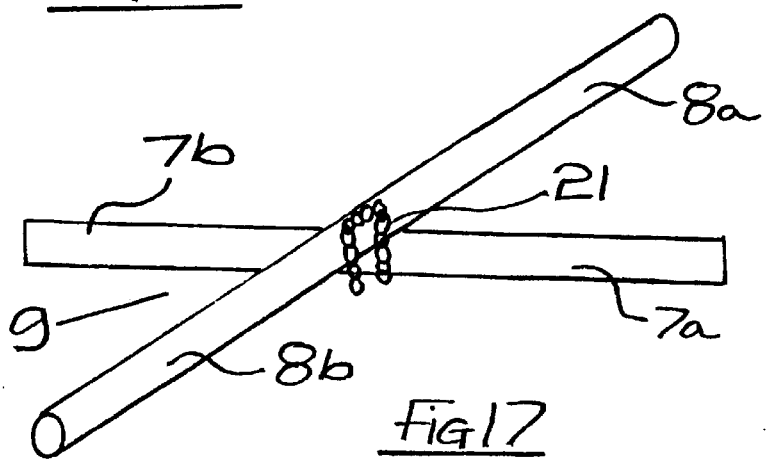

FIG. 17 illustrates physical anchorage by staples 21 illustrated by interrupted lines which could be again manufactured from any suitable reinforcing material or metal.

Figure 18:
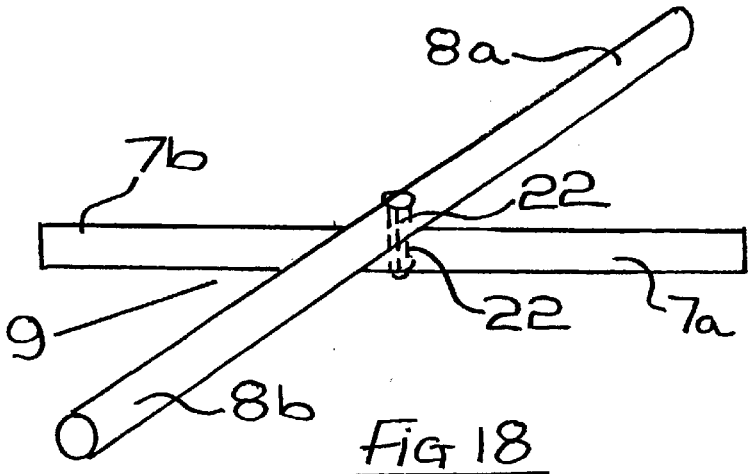

FIG. 18 shows vertical bars 8*a* and 8*b* and horizontal bars 7*a* and 7*b* anchored at the intersection 9 by a pin 22 again of any suitable material such as steel or a carbon reinforced material and shown by interrupted lines.

Figure 19:
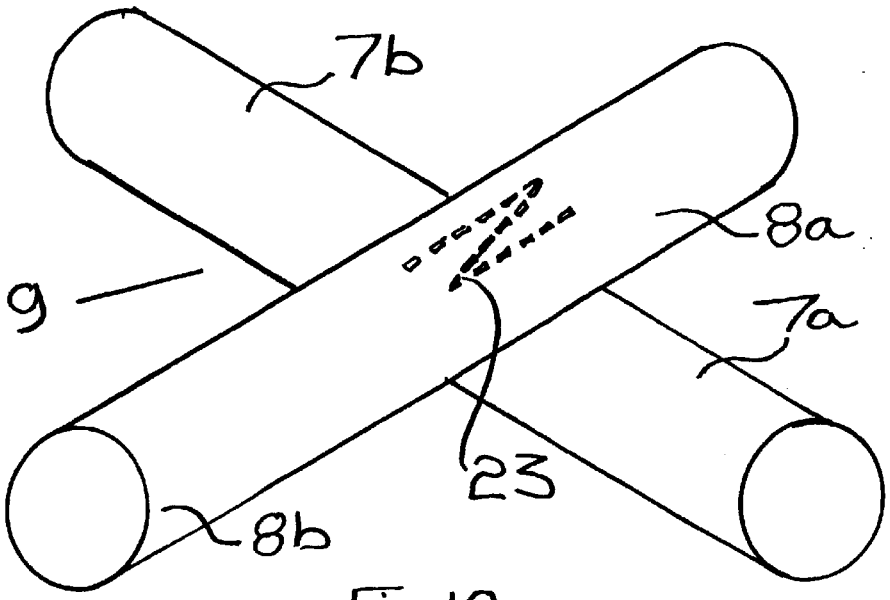

FIG. 19 illustrates vertical bars 8*a* and 8*b* again formed as a continuous bar 8 connected to horizontal bars 7*a* and 7*b* again formed as a continuous bar 7 by stitching 23. Any suitable fibre reinforcing material could be used as the thread for the stitching.

Various constructions of fibre reinforced polymer composite materials as well as many ways of physically anchoring the fibres of one bar to another have been described above and all of these can be used to provide the cage-like structure of the face mask 2 illustrated in FIGS. 1 and 2. Many others ways to achieve this can be used and will he readily apparent and easily derived from the description above.

It will be appreciated that once yarn of a plastics fibre reinforced composite polymer material has been provided and flexible bars are formed from one or more of such yarns that it is then possible to form from what are now flexible bars or ropes a cage like structure having bars meeting at intersections, which flexible bars are effectively physically anchored together. All of the structure can be readily achieved by the various constructions of yarns, and bundles of yarns together with the various physical anchoring as described above. Then all that is required is to subsequently process the pre-formed flexible cage like structure in a mould to produce the rigid structure. How this processing is performed will depend entirely on the materials used and is well know to those skilled in the art and does not require detailed description. However various other cage-like structures could be formed. It will be appreciated for example that other forms of physical anchoring could be used.

Figure 20:
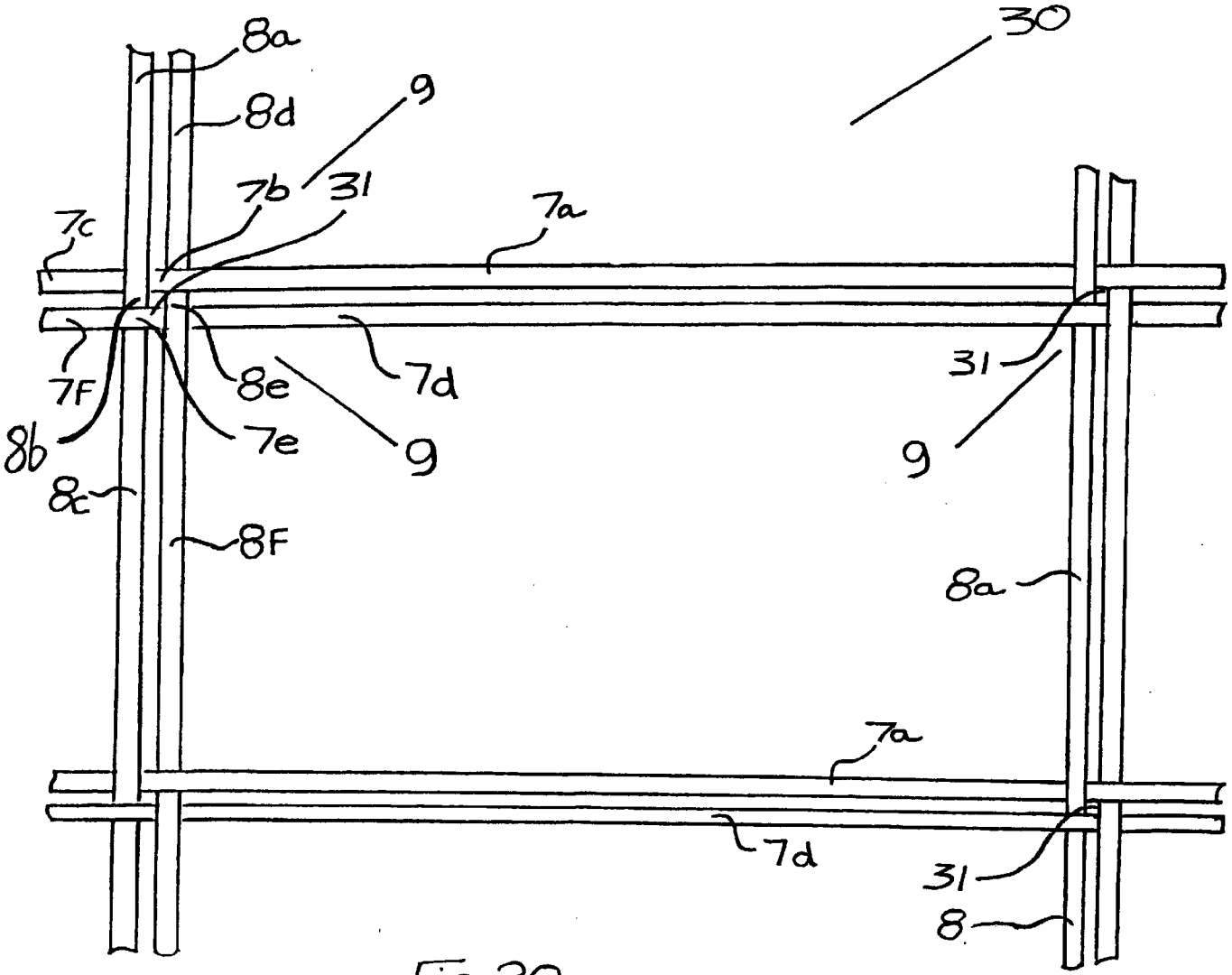
FIG. 20 illustrates a cage-like structure formed in accordance with the invention.
Figure 21:
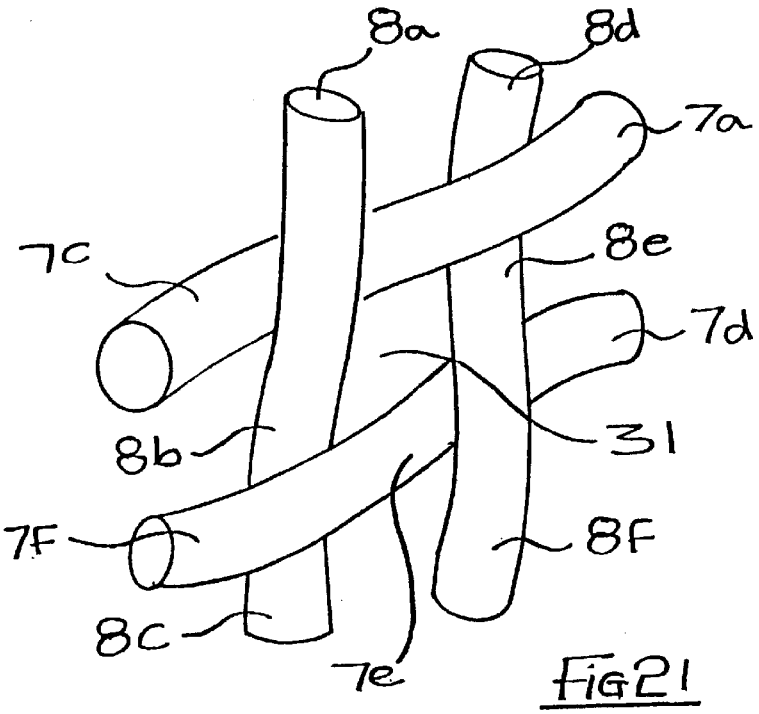
FIG. 21 is a perspective detailed view of the circled portion of FIG. 20.

Referring now to FIGS. 20 and 21 there is illustrated an alternative construction of cage indicated generally by the reference numeral 30 which could be used in the formation of protective headgear according to the invention. In this embodiment there is illustrated two sets of horizontal bars 7 namely a continuous horizontal bar formed from horizontal bars 7*a*, 7*b* and 7*c* close together and parallel with horizontal bars 7*d*, 7*e*, and 7*f* meeting at an intersection 9 with vertical bars 8*a*, 8*b* and 8*c* parallel to vertical bars 8*d*, 8*e* and 8*f*. It will be noted how the bars are physically anchored at the intersection 9 in what is effectively an intersection 9 with a hole 31 therebetween by each bar being interleaved with two adjacent bars lying above one and below the other. Obviously the distance between the horizontal bars 7 and the vertical bars 8 is not critical however the main purpose of the bars being close together at the intersection 9 is to achieve physical anchoring.

Figure 22:
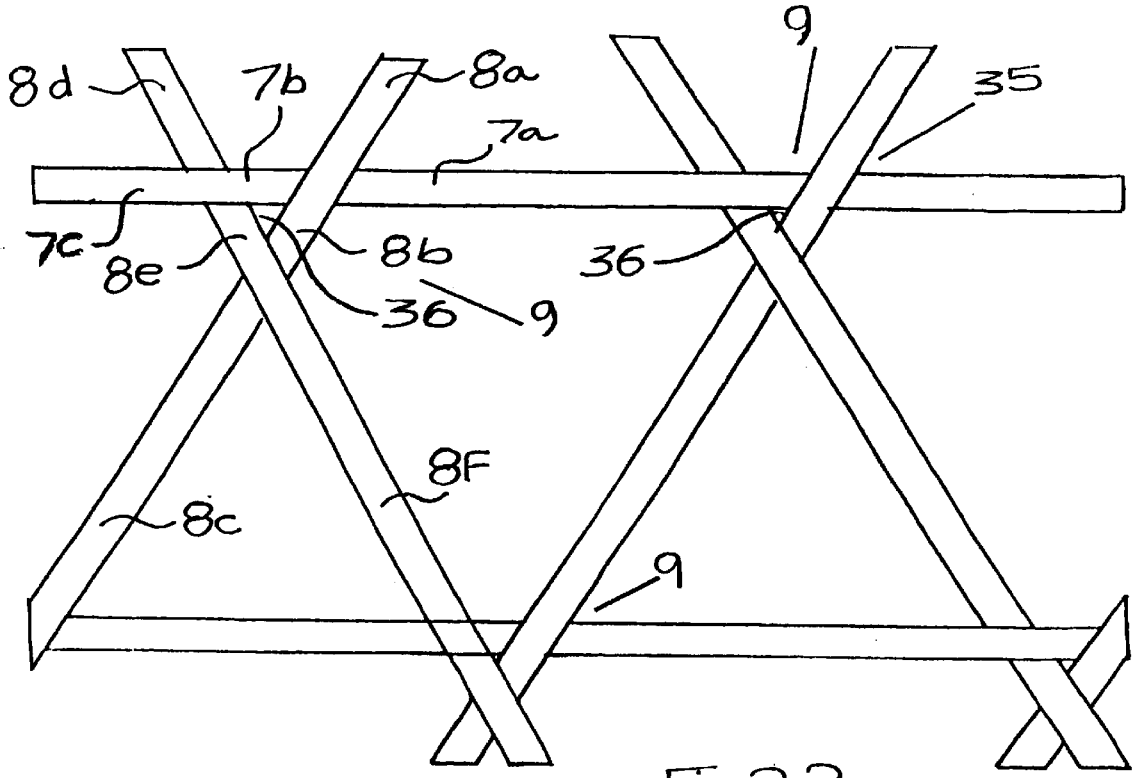
FIG. 22 is a view similar to FIG. 20 of an alternative cage-like structure according to the invention.

Referring now to FIG. 22 there is illustrated an alternative triangular cage-like construction indicated generally by the reference numeral 35 in which, one horizontal bar 7 formed by three in-line horizontal bars 7*a*, 7*b* and 7*c* intersects two inclined vertical bars 8 formed by two sets of in-line vertical bars 8*a*, 8*b* and 8*c* and 8*d*, 8*e*, and 8*f* respectively. Again the intertwining of the bars is clearly seen from the drawing as is a hole 36 at the intersection 9.

Figure 23:
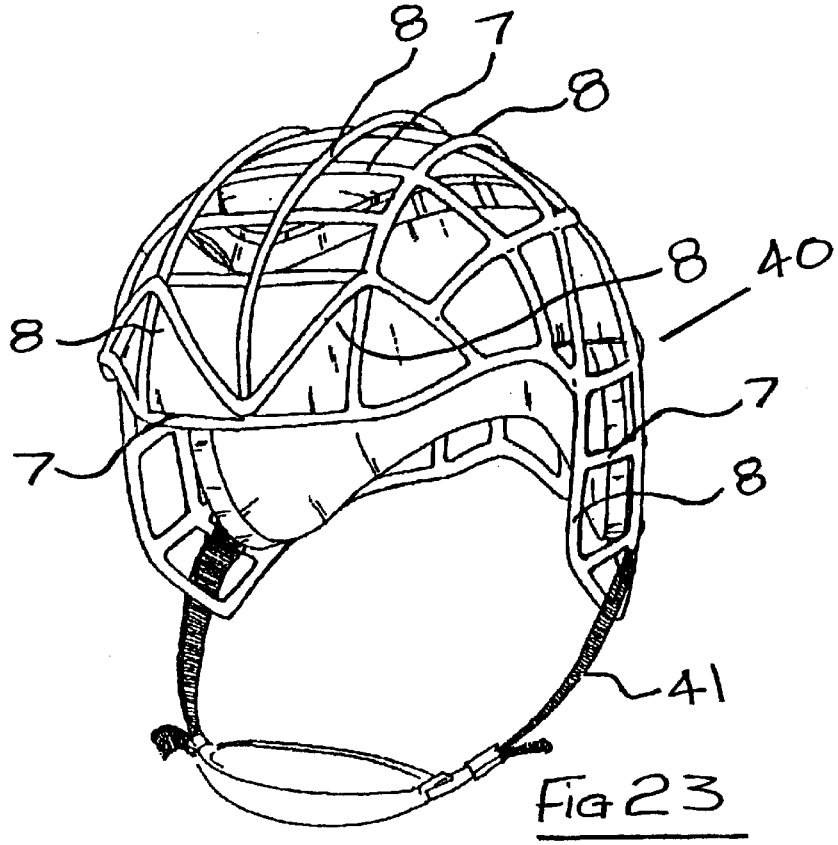
FIG. 23 is a perspective view of a sports helmet according to the invention.

Referring now to FIG. 23 there is illustrated a sports helmet indicated generally by the reference numeral 40 again of cage-like construction formed by a number of rigid bars identified as horizontal bars 7 and vertical bars 8, though it will be appreciated that some of the bars 8 are more properly inclined bars rather that strictly vertical bars and indeed when they progress across the top of a wearer's skull it could be said that they are actual horizontal bars, however, the terminology used is self-apparent. The helmet 40 has a chin-strap 41. The bars 7 and 8 are constructed as described hereinbefore. The openings in the helmet between the bars 7 and 8 are used to increase the air flow to the head and will be provided with suitable impact absorbing padding as is well known in the art and doesn't require any description. It will be appreciated that the use of fibre reinforced polymer composite material facilitates the construction of complex curved intricate shapes which are for all practical purposes impractical if not impossible with metal.

Figure 24:
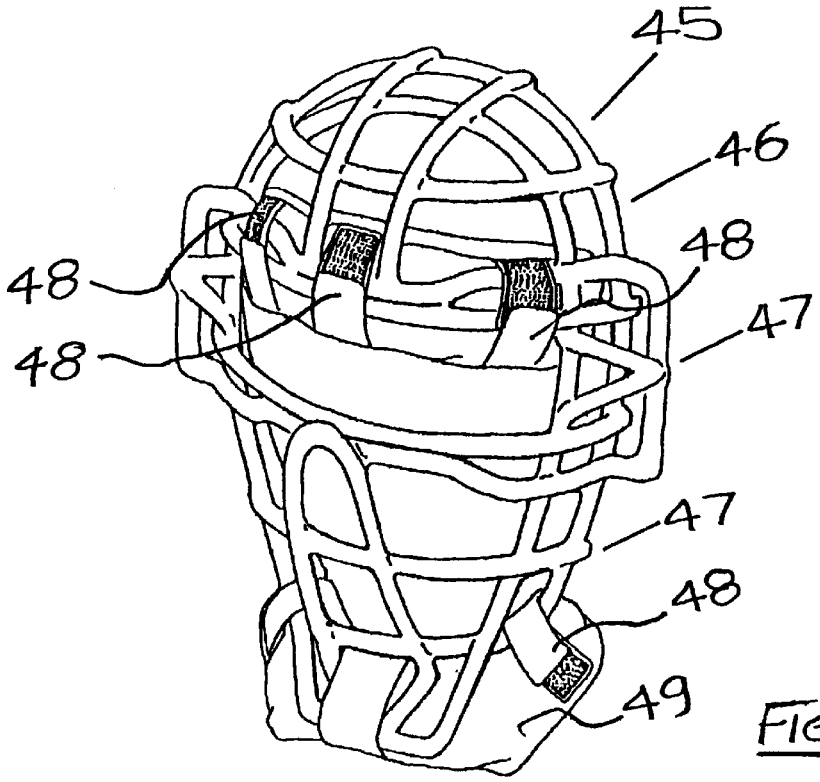
FIG. 24 is a perspective view of a baseball catchers mask.

FIG. 24 illustrates a baseball catcher's mask indicated generally by the reference numeral 45 comprising a helmet and a face guard indicated generally by the reference numerals 46 and 47 respectively connected together by loop straps 48. This is identical in appearance to a conventional steel mask. In this embodiment the helmet 47 projects down over the lower part of the wearer's face and is connected by further loop straps 48 to a collar 49. Again this is of conventional appearance, though obviously grid-like helmets have not been heretofore used except when made of welded steel.

Figure 26:
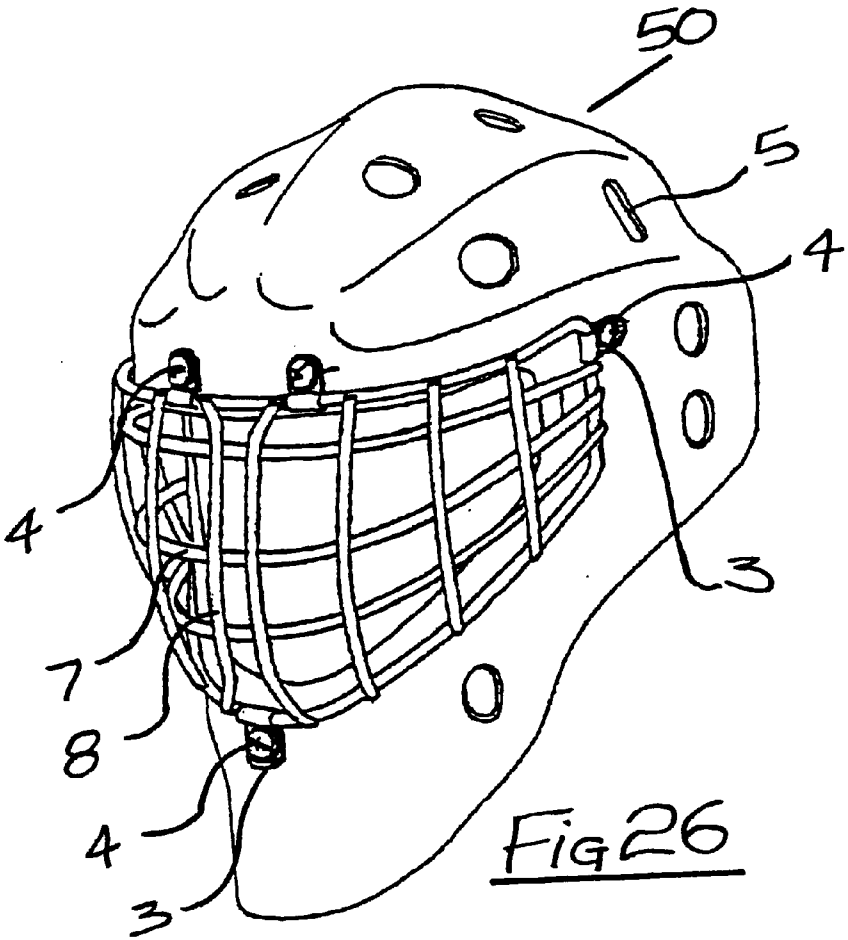
FIG. 26 is a perspective view from one side of the face guard and helmet of FIG. 25.
Figure 25:
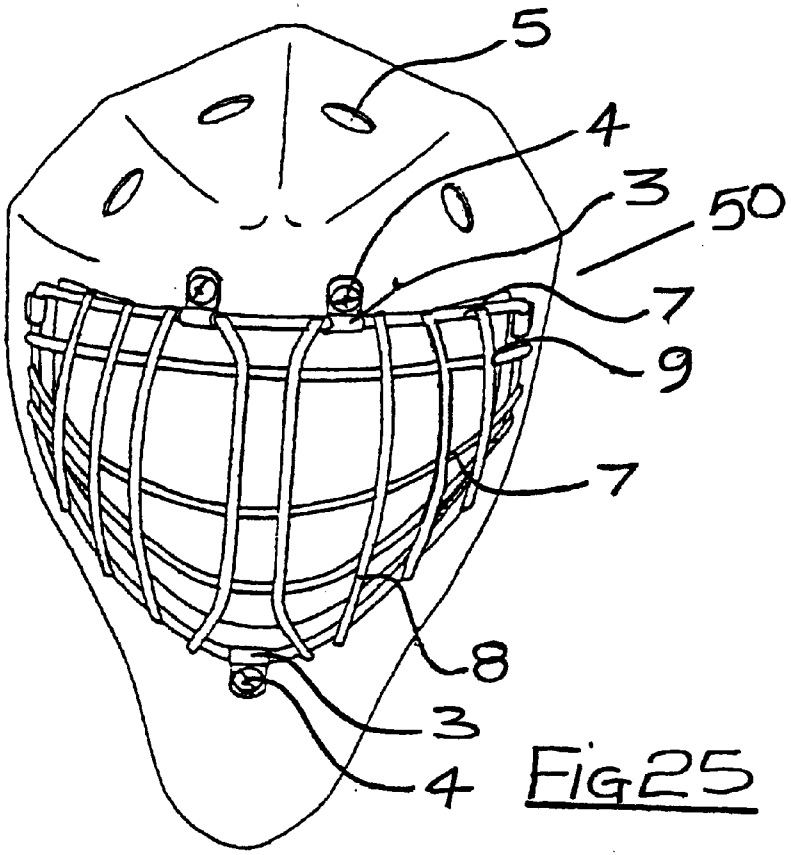
FIG. 25 is a front view of an ice hockey goalie's helmet and face guard.

Referring to FIGS. 25 and 26 there is illustrated an ice hockey goalie's helmet and face guard 50, again of substantially the same construction with similar parts to those illustrates in FIGS. 1 and 2 identified by the same reference numerals. In this embodiment the face mask 2 is rigidly secured in position by the loop straps 3 and rivets 4.

Figure 27:
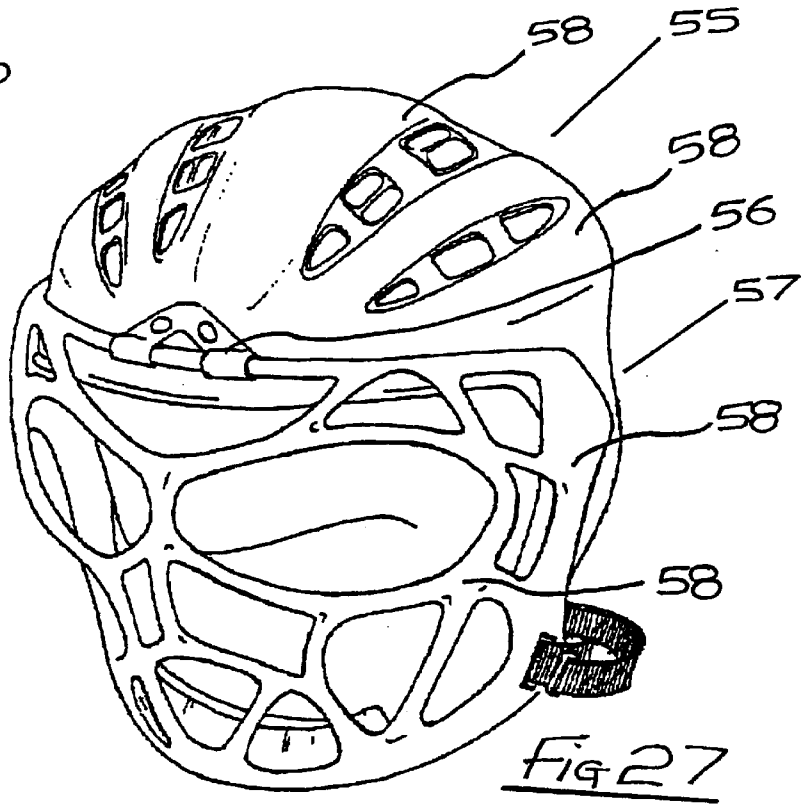
FIG. 27 is a perspective view of an alternative construction of protective headgear according to the invention.

In FIG. 27 there is illustrated a further construction of protective headgear in this case a helmet indicated generally by the reference numeral 55 pivotally mounting by a hinge 56 a face mask indicated generally by the reference numeral 57. In this embodiment the face mask 57 and helmet incorporate a plurality of in-fill panels 58 formed of a fibre reinforced composite polymer material co-consolidated with the bars.

Figure 28:
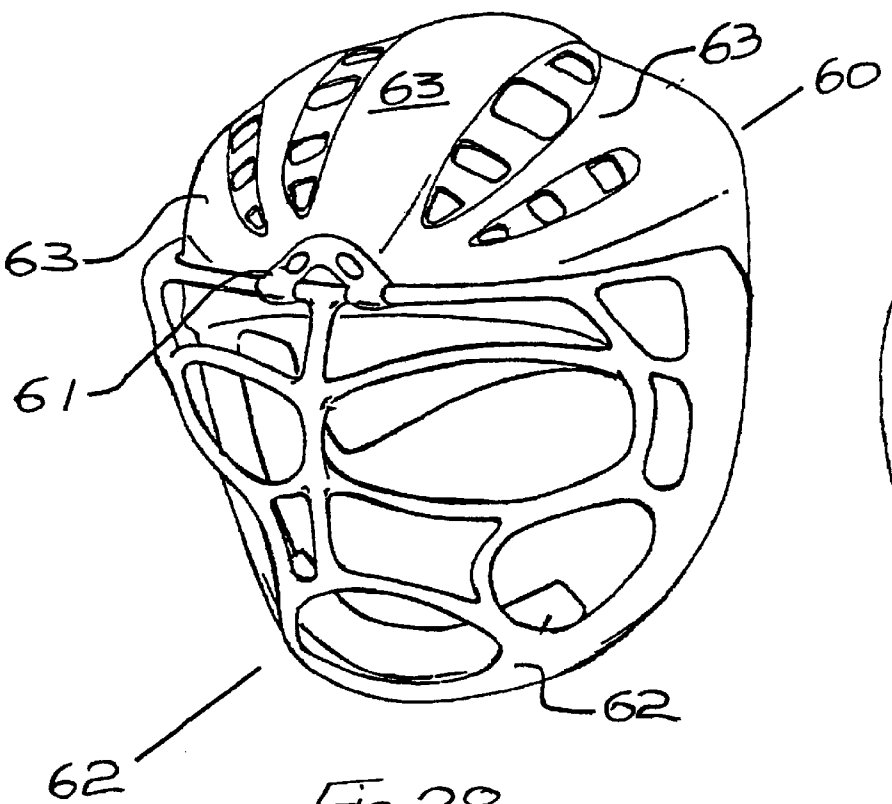
FIG. 28 is a perspective view of a still further construction of protective headgear according to the invention.

FIG. 28 illustrates a still further construction of helmet indicated generally by the reference numeral 60 mounting by a hinge 61, a face guard indicated generally by the reference numeral 62. Again it incorporates infill panels 63.

When manufacturing a face mask or helmet according to the present invention yarns or bundles of yarns will be formed together to effectively form a flexible structure of a number of bars meeting at these intersections where the bars will be securely anchored together. Then the fibres of each flexible bar will be processed in a suitable way so that the pre-formed flexible cage-like structure is formed into a rigid structure. This will generally be carried out in a mould as is conventional. However, it is envisaged that alternatively there could be provided a mould having the desired cage-like structure for bars meeting at intersections, where the method would comprise forming reinforcing fibres into a fibres only yarn and then the fibres only yarn would be laid in a mould. The reinforcing fibres would then be connected together at each intersection so that at least some of the fibres of the fibres only yarn are physically anchored by the fibres of another fibres only yarn so that some of the fibres of each fibres only yarn are above and below the fibres of the other fibres only yarn and then subsequently introducing thermosetting or thermoplastics polymer material into the mould and processing the polymer material to form rigid bars of fibre reinforced composite material co-consolidated together at the various intersections.

It will also be appreciated that where infill panels are used the use of moulds in both types of construction will relatively easily achieve a co-consolidation of the infill panels and the bars. Further, it will be appreciated that in the case of a thermoplastics material the preform will be placed in a mould and pressure and heat will be applied to it so that the polymer fibres melt and totally impregnate the reinforcing fibres to form what is effectively solid bars and structure. In a conventional manner the mould will be cooled while the mask will be kept under pressure in the mould until either the face mask or the helmet is ready to be removed and used.

Alternatively, with a thermosetting polymer matrix, the application of heat and pressure will be applied to cause the chemical curing and cross-linking of the structure. In this case, there is no need to cool the mould, and the rigid mask or helmet may be removed from the hot mould once it is cured, according to conventional practices.

However, what has to be appreciated with the present invention is that the physical anchoring of yarns from one bar to another at intersections provides a load transfer mechanism from bar to bar as the reinforcing fibres pass around or through the fibres of intersecting bars. This serves to increase the performance of the protective headgear as a whole, distributing loads evenly between bars without any loss of properties at the intersections. If there were to be no physical anchoring of the fibres to each other, the performance of the structure would be dependent largely on the properties of the unreinforced polymer matrix material where the bars have been co-consolidated at the intersection. This material will migrate to provide a joint between the bars during co-consolidation of the structure. Unfortunately this results in material failures at the bar intersections, separation of bars from one another and in general a failure of protection. The worst feature being an impact may cause the bars to almost totally separate at an intersection, but not actually separate sufficiently to allow the user be aware of it and then a subsequent blow can have disastrous affects on the already weakened structure.

While in the above considerable emphasis has been placed on the construction of face masks, it will be appreciated that the technology is particularly suitable for the production of a helmet and since a helmet with a large number of holes therethrough would be much more comfortable to wear than a more solid helmet that such protective headgear will be particularly advantageous.

It will be readily appreciated that many of the designs and shapes shown above would be virtually impossible to achieve with conventional or traditional materials used in known manner.

It will also be appreciated that since protective foam can be placed strategically on the inside, for example, of a helmet to protect a wearer's head that since the helmet can be of a grid-like structure any shifting or deterioration of protective foam or reinforcing material will be readily easily seen and thus timely replacement or repair may be achieved.

It is also important to appreciate in accordance with the present invention that there is no limitation on the type of composite material that may be used.

While in the embodiments described above a considerable distinction has been made between yarns and bundles of yarns the distinction is largely made for the purposes of description and indeed a multiplicity of bundles of yarns could also be used.

It will be appreciated, as already mentioned and emphasised that many forms of material may be used and that many forms of reinforcing fibres such as carbon, glass, polyethylene, ceramic, or aramid materials may be used as are all described in the literature.

Similarly, the thermoplastic polymer matrix can be chosen, for example, from polyamide-12, polyamide-6, polyetheretherketone, or any other suitable polymer material. These particular materials are being mentioned as ones that are well known and are known to perform satisfactorily.

Similarly a thermosetting polymer matrix could be chosen from epoxy, polyester, phenylester, or indeed any suitable polymer. Again these polymers are simply mentioned as ones that are known to operate satisfactorily.

It is envisaged that in certain circumstances the helmets and face masks and protective headgear generally according to the invention may, as well as, incorporating bars in accordance with the present invention also incorporate bars of other materials such as metal.

It will further be appreciated that, as mentioned above, the actual method of manufacturing the protective headgear according to the present invention may be in accordance with well known techniques such as taking a commingled yarn of a thermoplastic polymer material and a reinforcing fibre and braiding it, then pre-forming the desired shape from the assembled braid and then either pre-heating the pre-form and placing it in a cool mould and subjecting the pre formed mask either for a helmet or a face mask to pressure to cause the thermoplastic material to bind to the reinforcing fibres, or, alternatively placing the pre-form in a heated mould and subjecting the pre-formed mask forming the face mask or the helmet to heat and pressure to cause the thermoplastic material to bind to the reinforcing fibres and then cooling the mould.

As mentioned above, some or all of the commingled thermoplastic composite yarn material could be replaced by a pre-impregnated thermoplastic composite material, or by pre-impregnated or liquid-infiltrated thermosetting matrix composite material.

Various methods of braiding, knitting, weaving, sewing, embroidering and other textile processes can be performed all of which are well known in accordance with the art.

It is envisaged that in some, but not all, methods of carrying out the invention the mould can be cooled to below the glass transition temperature of the polymer. For example, with a semi-crystalline polymer, the processing temperature could be around 250° C. and the de-moulding temperature, i.e. that to which the mould is cooled could be of the order of 120° C., which is above the glass transition temperature of nylon which could be above the glass transition temperature of the polymer, for example Polyamide, which has a glass transition temperature below 70° C. Alternatively, for an amorphous polymer, such as polycarbonate, the de-moulding temperature would have to be less than the glass transition temperature of the polymer.

In the specification the terms "comprise, comprises, comprised and comprising" or any variation thereof and the terms "include, includes, included and including" or any variation thereof are considered to be totally interchangeable and they should all be afforded the widest possible interpretation and vice versa.

The invention is not limited to the embodiment hereinbefore described, but may be varied in both construction and detail.

What is claimed is:

1. Protective headgear comprising:

a cage structure including rigid bars, each bar including a bundle of yarns, each yarn being formed of aligned reinforcing fibres embedded in a polymer matrix material;

a plurality of cage intersections comprising at least two bars meeting and co-consolidated together; and anchoring means for connecting at least some of the fibres of one bar to the fibres of the other bar at the intersection, the anchoring means being provided by interleaving at least some of the yarns of a bundle forming a bar to some of the yarns of another bundle forming another bar.

2. Protective headgear as claimed in claim 1 in which the bars are interconnected by infill panels formed of a fibre reinforced polymer composite material co-consolidated with the bars.

3. Protective headgear as claimed in claim 1 in which all the yarns of a bundle project through the bundle forming another bar at the intersection.

4. Protective headgear as claimed in claim 1 in which one bundle forming one bar is wrapped around another bar at the intersection.

5. Protective headgear as claimed in claim 1 in which one bundle forming one bar is wrapped around another bar and back on itself at the intersection.

6. Protective headgear as claimed in claim 1 in which one bundle is knotted to another bundle at the intersection.

7. Protective headgear as claimed in claim 1 in which some of the yarns forming a bar are turned at the intersection away from the other yarns, such that the yarns form at least part of two other bars projecting away from the intersection.

8. Protective headgear as claimed in claim 1 in which some of the yarns forming a bar are turned at the intersection away from the other yarns such that the yarns form from the intersection at least part of all the other bars at the intersection.

9. Protective headgear as claimed in claim 1 in which at least three bars form an intersection with a hole therebetween, each bar being interleaved with two adjacent bars lying above one and below the other.

10. Protective headgear as claimed in claim 1 in which there are four bars forming a substantially rectangular hole therebetween, each bar being interleaved with two adjacent bars lying above one and below the other.

11. Protective headgear as claimed in claim 1 in which the bundle comprises a plurality of lengths of yarn twisted together to form a coherent bundle.

12. Protective headgear as claimed in claim 1 in which the yarns forming each bundle are longitudinally arranged in side-by-side configuration.

13. Protective headgear as claimed in claim 1 in which the yarns forming each bundle are longitudinally arranged in side-by-side configuration and in which additional yarns are double-helically wrapped around the longitudinally arranged yarns to form an outside retention covering over a core of the longitudinally arranged collimated yarns.

14. Protective headgear as claimed in claim 1 in which the anchoring means includes additional yarn stitching the yarns together to interleave the additional yarn with the yarns at the intersection.

15. Protective headgear comprising:

a helmet;

a face mask of cage structure;

means for securing the face mask to the helmet;

a cage structure including rigid bars, each bar comprising a bundle of yarns, each yarn being formed of aligned reinforcing fibres embedded in a polymer matrix material;

a plurality of cage intersections comprising at least two bars meeting and co-consolidated together; and anchoring means for connecting at least some of the fibres of one bar to the fibres of the other bar at the intersection, the anchoring means being provided by interleaving at least some of the yarns of a bundle forming a bar to some of the yarns of another bundle forming another bar.

16. Protective headgear as claimed in claim 15 in which one bundle forming one bar is wrapped around another bar at the intersection.

17. Protective headgear as claimed in claim 15 in which one bundle is knotted to another bundle at the intersection.

18. Protective headgear as claimed in claim 15 in which some of the yarns forming a bar are turned at the intersection away from the other yarns, such that the yarns form at least part of two other bars projecting away from the intersection.

19. Protective headgear as claimed in claim 15 in which some of the yarns forming a bar are turned at the intersection away from the other yarns such that the yarns form from the intersection at least part of all the other bars at the intersection.

20. Protective headgear as claimed in claim 15 in which at least three bars form an intersection with a hole therebetween, each bar being interleaved with two adjacent bars lying above one and below the other.

21. Protective headgear as claimed in claim 15 in which there are four bars forming a substantially rectangular hole therebetween, each bar being interleaved with two adjacent bars lying above one and below the other.

22. Protective headgear comprising:

a helmet of cage construction;

a face mask;

means for securing the face mask to the helmet;

the helmet including rigid bars, each bar comprising a bundle of yarns, each yarn being formed of aligned reinforcing fibres embedded in a polymer matrix material;

a plurality of cage intersections comprising at least two bars meeting and co-consolidated together; and anchoring means for connecting at least some of the fibres of one bar to the fibres of the other bar at the intersection, the anchoring means being provided by interleaving at least some of the yarns of a bundle forming a bar to some of the yarns of another bundle forming another bar.

23. Protective headgear as claimed in claim 22 in which one bundle forming one bar is wrapped around another bar at the intersection.

24. Protective headgear as claimed in claim 22 in which one bundle is knotted to another bundle at the intersection.

25. Protective headgear as claimed in claim 22 in which some of the yarns forming a bar are turned at the intersection away from the other yarns, such that the yarns form at least part of two other bars projecting away from the intersection.

26. Protective headgear as claimed in claim 22 in which some of the yarns forming a bar are turned at the intersection away from the other yarns such that the yarns form from the intersection at least part of all the other bars at the intersection.

27. Protective headgear as claimed in claim 22 in which at least three bars form an intersection with a hole therebetween, each bar being interleaved with two adjacent bars lying above one and below the other.

28. Protective headgear as claimed in claim 22 in which there are four bars forming a substantially rectangular hole therebetween, each bar being interleaved with two adjacent bars lying above one and below the other.

29. Protective headgear comprising:

a helmet of cage construction;

a face mask of cage construction;

means for securing the facemask to the helmet; and the cage construction including rigid bars, each bar comprising a bundle of yarns, each yarn being formed of aligned reinforcing fibres embedded in a polymer matrix material;

a plurality of cage intersections comprising at least two bars meeting and co-consolidated together; and anchoring means for connecting at least some of the fibres of one bar to the fibres of the other bar at the intersection, the anchoring means being provided by interleaving at least some of the yarns of a bundle forming a bar to some of the yarns of another bundle forming another bar.

30. Protective headgear as claimed in claim 29 in which one bundle forming one bar is wrapped around another bar at the intersection.

31. Protective headgear as claimed in claim 29 in which one bundle is knotted to another bundle at the intersection.

32. Protective headgear as claimed in claim 29 in which some of the yarns forming a bar are turned at the intersection away from the other yarns, such that the yarns form at least part of two other bars projecting away from the intersection.

33. Protective headgear as claimed in claim 29 in which some of the yarns forming a bar are turned at the intersection away from the other yarns such that the yarns form from the intersection at least part of all the other bars at the intersection.

34. Protective headgear as claimed in claim 29 in which at least three bars form an intersection with a hole therebetween, each bar being interleaved with two adjacent bars lying above one and below the other.

35. Protective headgear as claimed in claim 29 in which there are four bars forming a substantially rectangular hole therebetween, each bar being interleaved with two adjacent bars lying above one and below the other.

36. Protective headgear comprising:

a cage structure including rigid bars, each bar comprising a bundle of yarns, each yarn being formed of aligned reinforcing fibres embedded in a polymer matrix material;

a plurality of cage intersections comprising at least two bars meeting and co-consolidated together; and anchoring means for connecting at least some of the fibres of one bar to the fibres of the other bar at the intersection, the anchoring means being provided by additional yarn stitching the yarns together to interleave the additional yarn with the yarns at the intersection.

37. Protective headgear as claimed in claim 36 in which one bundle forming one bar is wrapped around another bar at the intersection.

38. Protective headgear as claimed in claim 36 in which one bundle forming one bar is wrapped around another bar and back on itself at the intersection.

* * * * *